US005250768A

United States Patent [19]

Van Fossen

[11] Patent Number: 5,250,768

[45] Date of Patent: Oct. 5, 1993

[54] FLOAT SWITCH WITH SNAP ACTION MEMBER

[75] Inventor: Robert A. Van Fossen, Auburn, Ind.

[73] Assignee: Johnson Service Company, Milwaukee, Wis.

[21] Appl. No.: 822,350

[22] Filed: Jan. 17, 1992

[51] Int. Cl.[5] ..... H01H 35/18

[52] U.S. Cl. ..... 200/84 R; 73/318; 200/542; 340/625

[58] Field of Search ..... 73/308, 313, 318, 321; 417/40; 340/623, 624, 625; 307/118; 200/51 R, 61.2, 84 R, 85 R, 61.52, 416, 542, 573

[56] References Cited

U.S. PATENT DOCUMENTS

| | | | |
|---|---|---|---|
| 3,090,849 | 5/1963 | Coulin | 200/84 R |
| 4,349,711 | 9/1982 | Lake | 200/81.9 R |
| 4,392,034 | 7/1983 | Payne | 200/573 |
| 4,418,712 | 12/1983 | Braley | 137/312 |
| 4,644,117 | 2/1987 | Grimes | 200/84 R |
| 4,692,576 | 9/1987 | Frede | 200/84 R |
| 4,755,640 | 7/1988 | Cooley | 200/84 R |

*Primary Examiner*—Gerald P. Tolin

*Attorney, Agent, or Firm*—Joseph E. Root, III; E. L. Levine

[57] ABSTRACT

A float switch for sensing a liquid level and switching between "on" and "off" states in response to the same. Overall, the device is carried within a hollow housing, with its movement restrained by the tethering action of a power cord. "Snap action" switching is achieved by the interaction between an actuator having camming surfaces formed on its exterior, and a spring-loaded switch mechanism. The switch mechanism includes a thin, flexible E-shaped snap member, having two legs bowed to form a leaf spring and having a bearing point located on the central leg. The actuator is carried in a tube within the housing and the switch mechanism is positioned adjacent the actuator's path of travel, so that a camming surface of the actuator can make contact with the bearing point. As the water level rises, an increasing proportion of the actuator's weight is carried by the bearing point, until the vertical component of the actuator weight exceeds the spring resistance of the snap member. The characteristic operation of the spring is such that it yields only suddenly and completely rather than gradually, providing a desirable snap action operation.

1 Claim, 2 Drawing Sheets

FLOAT SWITCH WITH SNAP ACTION MEMBER

BACKGROUND OF THE INVENTION

This invention relates to the field of switches, and more particularly to the field of floatable switches designed to sense a liquid level and operate a switch in response to the same.

The problem of determining a liquid level and taking action based on that data can be seen in a number of settings. The familiar toilet tank, for example, includes a float switch of the pivoting lever type, in which a buoyant object is fixed to one end of a lever arm. The other end of the lever is pivoted about a fixed point, and action can be taken by the lever itself (as seen in the toilet example, where the lever operates the water cut-off switch) or by an orientation-sensitive device within the float, as shown in U.S. Pat. No. 3,090,849 Coulin, May 21, 1963.

A primary disadvantage of the lever arm approach is the space required to accommodate the lever. The art has thus introduced a free-floating switch, retained in place by the tethering action of a flexible device such as a power cord.

Regarding the switch itself, the classic solution to the orientation-sensitive switch is the mercury switch, in which a quantity of mercury is contained within a vessel into which electrical conductors are inserted. The mercury moves within the vessel, and at certain vessel orientations the mercury overlies both conductors, completing the electrical circuit. The hazards of working with mercury have reduced the popularity of this type of switch.

Design objectives for an electro-mechanical switch include reliability and simplicity. An important factor in gaining reliability is freedom from contact arcing, which occurs when the switch contacts are in close proximity. The difficulty here is that the changes in liquid level sensed by a float switch are relatively slow. If a switch's contact spacing were directly proportional to the liquid level, arcing would occur for an unacceptably large portion the operating range. It is desirable, therefore, to achieve a "snap" action, in which the switch contacts are rapidly moved from full mutual contact to a position of wide separation. A typical embodiment of this concept is seen in U.S. Pat. No. 4,692,576 Frede, Sep. 8, 1987, in which a conventional switch, operated by a lever arm, is encapsulated within a float housing. A ball is provided within the housing to operate the switch lever by moving with a chamber. The chamber has two portions, divided by a ledge, which prevents the ball from moving until the float reaches a predetermined angle. Another ball operated device is shown in U.S. Pat. No. 4,644,117 Grimes, Feb. 17, 1987, in which the ball's movement is restrained by magnets rather than by a ledge.

Similarly, U.S. Pat. No. 4,755,640 Cooley, Jul. 5, 1988 utilizes a weight travelling back and forth on a post. Here the lever arm includes a cam follower portion that rides on the surface of the weight to operate the switch. According to the disclosure, snap action is achieved by the static friction between the weight and the post.

All of these device possess significant drawbacks. First, they all use a number of preassembled commercial components. All use at least a commercial switch mechanism, and the '117 disclosure includes a complex assemblage of parts. Such mechanisms introduce higher cost and greater complexity into the design. Further, the reliability of these designs seems to flow directly from their complexity. The sliding weight of the '640 patent offers only limited precision and repeatability, as it depends on the static friction between components, which can vary greatly. On the other hand, the reliability demonstrated by the other devices is only achieved at a price of high cost and complexity.

The art has yet to produce a float switch that offers a combination of simplicity and reliability. Those objectives are realized in the present invention.

SUMMARY OF THE INVENTION

The broad object of the present invention is to provide a simple and reliable floating switch for sensing liquid level and providing switching action in response thereto.

Another object of the invention is to provide a float switch that operates with a "snap" action to minimize arcing at the contacts thereof.

A further object of the invention is to provide a float switch that provides "snap" action in both switching directions (i.e., off to on and vice versa).

These and other objects are achieved in the present invention of an improved float switch for controlling electrically powered devices by sensing a liquid level and switching from an "on" position to an "off" position in response to changes in the same. The invention broadly includes a hollow housing adapted to float on the liquid, including upper and lower housing shells, hermetically joined to prevent the entry of liquid, so the housing floats on the liquid surface. An electric cord extends from the lower housing shell, secured at a tether point below the liquid level to permit free movement of the housing on the liquid surface, so that a change in liquid level results in a change in orientation of the transverse axis of the housing. A spring loaded normally-open switch is electrically connected to the cord and carried within the lower housing shell. This switch includes a bearing point for moving the switch from the open condition to a closed condition in response to an application of pressure on the same.

A generally cylindrical actuator is carried adjacent to the switch, able to move within the housing between first ("off") and second ("on") positions in response to the orientation of the housing. The exterior of the actuator forms a camming surface, with each portion of the surface adapted to interact with the bearing point for operating the switch. Specific camming portions include a dwell portion adapted to make no contact with the bearing point; a snap portion flaring outward from the dwell portion for a distance sufficient to make contact with the bearing point and to move the same a distance greater than the distance required to operate the switch; and a detent portion, having a circumference less than the circumference of the distal end of the snap portion. The weight of the actuator is selected such that the force applied to the bearing point as the transverse axis of the housing tilts from horizontal toward the vertical, overcomes the resistance of the switch's spring loading of the switch at a preselected angle of the housing, providing a snap action closing of the switch.

In a particular embodiment of the invention, the spring loaded switch includes a pivot terminal and a snap member. The pivot terminal has generally parallel arms extending from a base, giving it a U-shaped form. It is mounted in the lower shell with the open end of the U-shaped portion aligned transverse to the actuator's axis of travel. The snap member is generally E-shaped, with three parallel legs extending from a transverse bar. The central leg is longer than the outer legs and extends beyond them. The snap member is joined to the pivot terminal by having the snap member central leg extend into the U-shaped portion of the pivot terminal, with the distal end thereof affixed to the pivot terminal base member. Each of the snap member outer legs is affixed to the termination of the pivot terminal arms, so that the outer legs are bowed in the same direction, forming a leaf spring. The bearing point is carried on the snap member central leg.

DETAILED DESCRIPTION OF A PREFERRED EMBODIMENT

Figure 1:
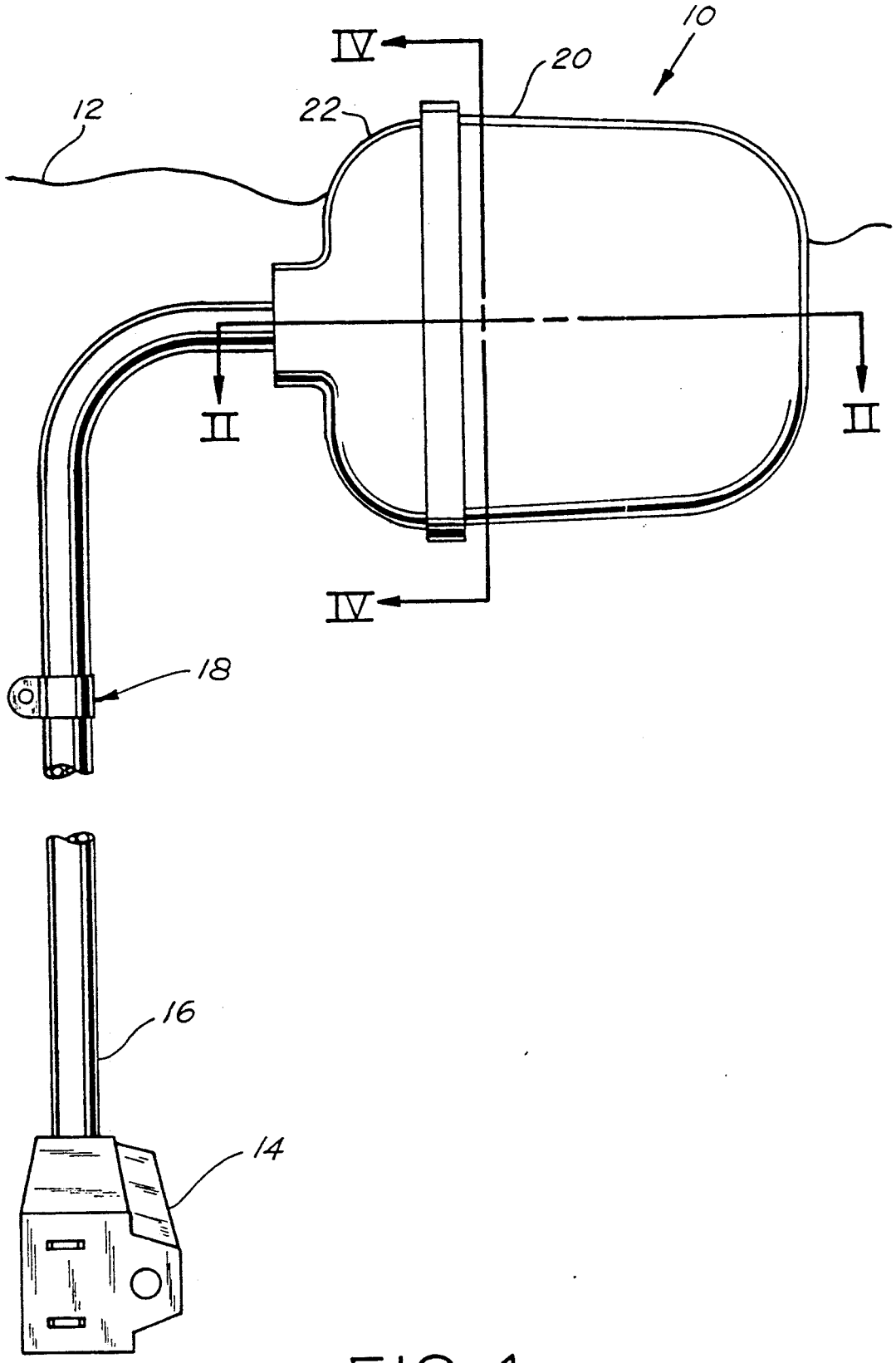
FIG. 1 is a side view of an embodiment of the present invention.

An improved float switch 10 according to the present invention can be seen in FIG. 1. Although a number of different embodiments could be constructed following the guidance set out herein, the embodiment shown is contemplated for use incontrolling a sump pump (not shown), by sensing the water level 12 in the space to be pumped and turning the pump power on and off at selected levels.

As is known in the art, the control of electric power to a controlled device can be conveniently accomplished by employing a feed-through plug 14, having both male and female connectors, so that it is plugged into a standard 110-volt outlet and the controlled device is plugged into it. A switch connected to control power cord determines whether or not electricity is available to the controlled device.

The float switch is enclosed within a hollow housing, which itself consists of upper and lower housing halves 20, 22, respectively. The housing is generally adapted to float on the surface of the water, and the power cord 16 not only provided the electrical connection but also it locates the unit within the water to be measured. The cord is anchored at tether point 18, which can be any suitable fixed location within the sump or well. The unit is then free to move as the water level varies, and as it does so the horizontal orientation of its transverse axis will tilt, as seen most clearly in FIGS. 2(*a*) and (*b*).

Those in the art will appreciate the range of suitable materials for the housing halves. Plastic materials, such as polypropylene are preferred, with polyphenolene oxide such as Noryl being most preferred, formed by a suitable process such as injection molding. The two halves are hermetically sealed to prevent liquid penetration. Again, any of a number of known processes will suffice, such as adhesive bonding or ultrasonic welding. The lower housing shell receives the power cord 16 through cord aperture 24, which is also sealed with a suitable material, such as epoxy potting compound 26.

Figure 4:
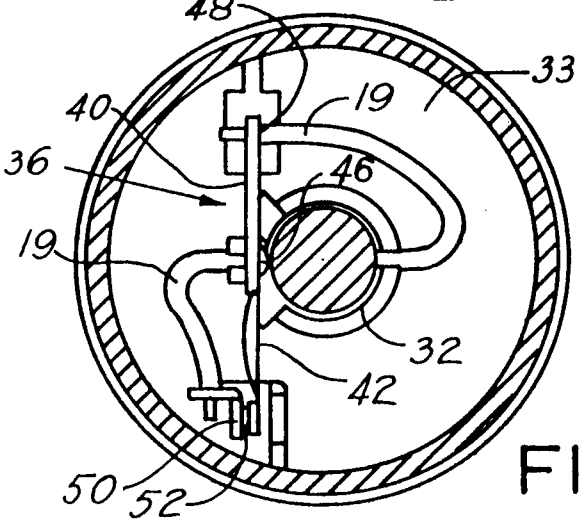
FIG. 4 is a top sectional view of the embodiment shown in FIG. 1, taken along plane IV of FIG. 1.

The interior of upper housing shell 20 includes a tube 28, with walls 30 and a stop post 31, generally lying coaxial with the transverse axis of the housing. The distal end of the tube mates with a well 32 formed in the floor 33 of the lower housing half, as also seen in FIG. 4. Other features of the housing will become apparent from the following discussion.

Figure 2A:
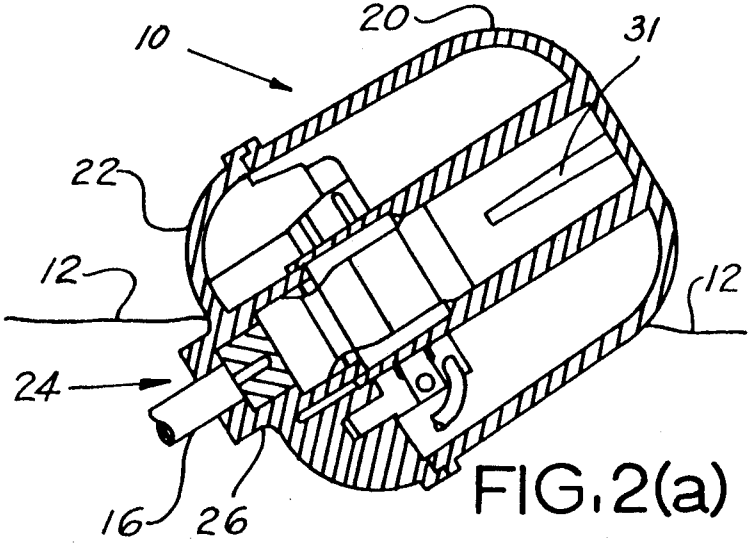
FIGS. 2 (*a*) and (*b*) are half-sectional side views of the embodiment shown in FIG. 1, taken along plane II of FIG. 1, showing the invention working at different water levels.
Figure 2B:
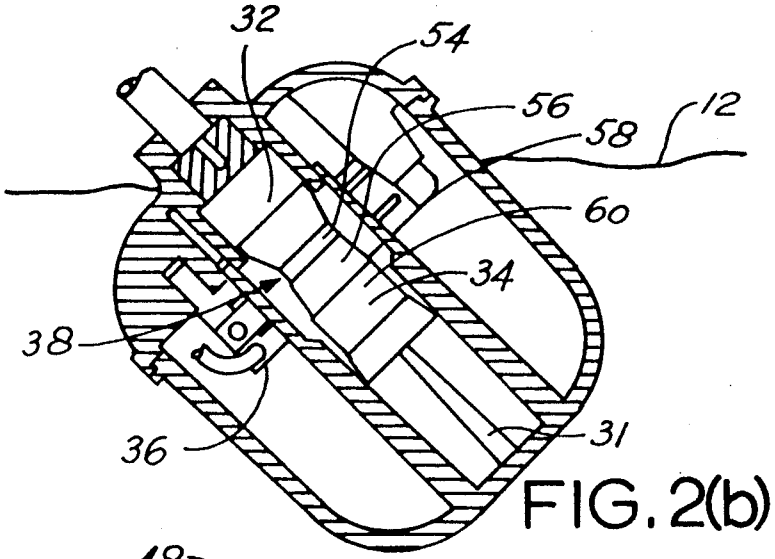

The switching function of the invention is accomplished by the interaction of an actuator 34 and a switch assembly 36, seen in FIGS. 2(*a*), 2(*b*) and 4. Very broadly speaking, the actuator reciprocates within the tube, under the influence of gravity as determined by the housing orientation, to operate the switch. Several points are important in appreciating the invention, however. First, it is desirable to avoid a condition in which switch contacts are placed close together for any longer than is absolutely necessary, to avoid arc generation and its attendant wear and power waste. Thus, a "snap" action is sought, that suddenly closes or opens the switch contacts. Moreover, the number and type of moving parts must be held to a minimum, to ensure reliability and long life.

The actuator 34 is designed to reciprocate within the tube, under the influence of gravity. As seen in FIG. 2(*a*) and 2(*b*), the actuator is generally cylindrical in form, dimensioned for sliding movement within the tube. It is preferred that the actuator be relatively massive for its size, so a somewhat heavy material is preferred, such as brass. A designer must also consider friction between the actuator and the tube itself in selecting the materials employed. Given the teaching herein, those in the art will be able to select a tube/actuator combination that allows the actuator to move at selected orientations of the housing. The surface of the actuator is formed into a series of camming surfaces 38, as discussed more fully below.

Figure 3:
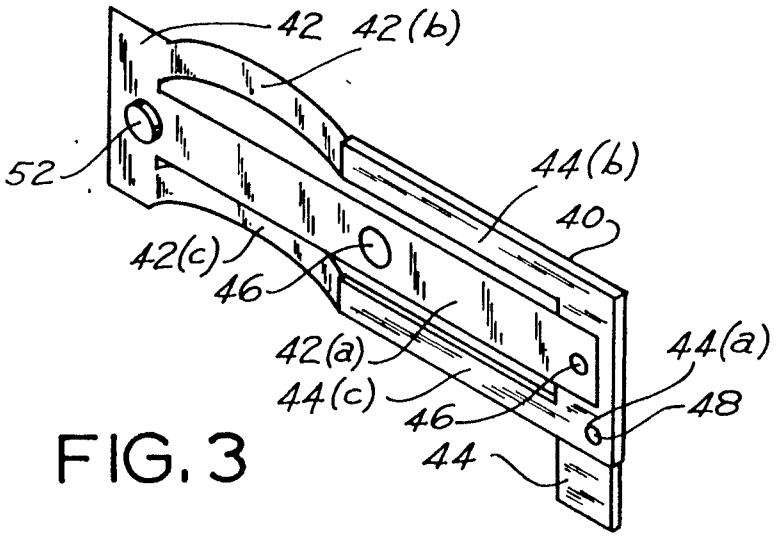
FIG. 3 is a detail perspective of the switch assembly of the embodiment shown in FIG. 1.

Switch assembly 36 operates in cooperation with the actuator to provide control operation. Shown in detail in FIG. 3, the switch assembly 36 includes a pivot terminal 40 and a snap member 42. The pivot terminal is a generally U-shaped metallic element, with a stake post 44 projecting transversely from its short (base) side 40(*a*). This terminal is mounted inside the lower housing shell, as seen in FIG. 4, by inserting the stake post into an appropriate opening formed in floor 33, so that the pivot terminal lies in a plane parallel to the long axis of the housing, adjacent the tube 28.

A snap member 42 is attached to the pivot terminal. This member is also generally rectangular, but it is formed from thin, flexible metallic material, such as a beryllium copper alloy. The member generally resembles the letter E, but with the central leg 42(*a*) extended well beyond the body of the member. This central leg is attached to the base side of the pivot terminal by suitable means, such as by rivet 46, and the distal ends of the upper and lower legs are inserted into slots formed into the upper and lower arms 40(*b*), 40(*c*) of the pivot terminal.

Spring action in the snap member is achieved by mounting the snap member such that the length of the snap member central leg is slightly greater than the combined lengths of the snap member upper and lower legs and the pivot terminal upper and lower arms. To accommodate this difference, the upper and lower snap member legs are bent into shallow semicircles, bowed in a direction away from the tube 28, forming leaf springs. A bearing point 46, preferably a convex button of plastic material staked into an aperture in the approximate middle of the snap member central leg, provides a convenient location for applying a motive force C to the snap member. Application of such a force, as discussed below, would urge the extreme end of the snap member in the direction shown by arrow A, while the restorative spring force would tend to return the member in direction B.

A distinctive feature of this leaf spring arrangement is that it provides a "snap" action rather than a gradual movement of the contact point. As force is applied along arrow C (FIG. 3), the central leg 42(*a*) bows in the direction of arrow C. At the extreme end of the snap member, however, movement in direction A is resisted by the leaf spring, so that contact point 52 remains stationary while bearing point 46 moves in direction C, pushed by the actuator. This situation continues until the force applied at the bearing point (applied by the vertical component of the actuator's weight vector, explained more fully below), exceeds the leaf spring yield point, at which time the leaf spring yields suddenly and completely, allowing the end of the snap member to snap toward the contact post, bringing the contact points into junction and closing the switch.

The switch is wired into the electrical circuit, as follows. The individual wires 19 from power cord 16 are attached by conventional means, such as soldering, respectively to a connecting aperture 48 formed in the base side 44(*a*) of the pivot member, and to a connector post 50, mounted in the lower housing shell adjacent the free end of the switch assembly. Both the connecting post and the snap member have contact points 52, as known in the art, arranged for mutual contact.

Actuator 34 applies force to the bearing point 46 through camming surfaces 38 formed on its cylindrical surface. As seen in FIGS. 2(*a*) and (*b*), there four such surfaces are provided: a disengagement surface 54, having a diameter sufficiently small that the actuator surface makes no contact with bearing point 46; an engagement surface 56, sloped from the diameter of the disengagement surface to a diameter sufficiently large to force the "snap" action of the snap member; a detent surface 60, having a diameter sufficiently large to hold the snap member in contact with the contact post, and detent lip 58, joining the engagement and detent surfaces with a diameter slightly greater than that of the detent surface.

Operation of the unit can best be visualized in FIGS. 2(*a*) and (*b*). In the latter illustration, the water level 12 is at a point where the power cord tether point (not shown in this drawing) lies above the water level. Thus, the float switch is oriented with the lower housing tilted upward, and the actuator lies at the extreme end of the tube, bearing against stop post 31. Here the bearing point 46 is in registration with the disengagement surface 54 of the actuator, so no contact occurs between these elements.

As the water level rises, the housing changes orientation, going from the "nose down" attitude of FIG. 2(*b*) to a level position as the water level reaches the cord tether point, to the "nose up" position of FIG. 2(*a*). This vertical tilt impels the actuator to slide down the tube toward well 32, but before it reaches that point, the slope of the engagement surface makes contact with the bearing point 46. Of course, the force exerted on the bearing point is a function of the housing tilt angle. As described above, the resistance of the leaf spring initially prevents any movement of the far end of the snap member as the bearing point load increases (and the bearing point deflects in direction C). At the yield point of the leaf spring, however, the resistance abruptly drops, allowing the snap member contact point to move rapidly against the contact post. During this movement, the actuator itself completes its travel down the tube, moving into well 32. The detent lip 58 moves past the bearing point, which is placed in contact with the detent surface 60. The electrical circuit is thus completed and the controlled device receives electric power.

The opposite actions occur as the water level 12 falls from the position of FIG. 2(*a*) to the lower level of FIG. 2(*b*). Here the detent lip 58 engages the bearing point 46 as the unit falls, holding the actuator in contact with the bearing point, and thus maintaining the switch in a closed position, until the vertical component of the actuator's weight vector exceeds the resistance of the spring. The spring structure then produces a "snap" action, quickly moving the contacts apart to prevent or minimize arcing between the contact points. As the water level continues to fall, the actuator slides down the tube, coming to rest against the stop post 31.

As will be understood by those in the art, several design points should be considered in incorporating the present invention into a working switch mechanism. Primarily, switch action depends on the point at which the actuator operates the snap member to complete the switch circuit. That point in turn is determined by the particular geometry, material and construction of the actuator, the spring constant of the snap member, and the coefficient of friction between the actuator and the tube. Given the disclosure above, those in the art are capable of performing the calculations and design choices to produce switch operation at a desired orientation of the switch housing.

A wide variety of such design choices can be exercised without departing from the spirit of the invention. For example, changes in the material of the housing and the actuator will alter the sliding characteristics of the actuator in the tube, affecting the operational point of the switch. Also, the switch can be designed for a normally-open configuration (as illustrated above) or in a normally-closed arrangement, to supply power when the housing is in a "nose down" attitude. These and other changes fall within the scope of the invention, which is defined solely by the claims appended hereto.

I claim:

1. An improved float switch for controlling electrically powered devices by sensing a liquid level and switching from an "on" position to an "off" position in response to changes in the same, comprising:

hollow housing means adapted to float on liquid, including upper and lower housing shells, said shells being hermetically joined to prevent the entry of liquid;

an electric cord extending from said lower housing shell, said cord being secured at a tether point below the liquid level to permit free movement of said housing means on the liquid surface, wherein a change in liquid level results in a change in orientation of the transverse axis of said hollow means;

spring-loaded switch means for completing electrical circuit across said electrical cord, said switch being biased toward an open condition, electrically connected to said cord and carried within said lower housing shell, said switch means including a bearing point means for moving said switch from said open condition to a closed condition in response to an application of pressure on said bearing point; including a pivot terminal, having generally parallel arms extending from base member to define a generally U-shaped portion thereof, mounted within said lower shell with the open end of said U-shaped portion aligned transverse to the axis of travel of said actuator means;

a snap member, formed of a thin, flexible electroconductive material, generally E-shaped with three generally parallel legs extending from a transverse bar, having the central leg thereof extending beyond the outer legs, said snap member being joined to said pivot terminal by having said snap member central leg extended into said U-shaped portion of said pivot terminal, with the distal end there of affixed to said pivot terminal base member, with each of said snap member outer arms being affixed to the termination of said pivot terminal arms, such that said outer legs are bowed in the same direction in the same direction, forming a leaf spring; and said bearing point means, carried on said snap member central leg;

actuator means, generally cylindrical in form, carried adjacent to said switch means in said housing for gravitationally-induced movement between first and second positions in response to said orientation of said housing means, said actuator means having a camming surface formed on the surface thereof, divided into a plurality of camming portions circumferentially around said actuator means, each said camming portion adapted to interact with said bearing point means for operating said switch means; said camming portions including:

a dwell portion adapted to make no contact with said bearing point, a snap portion flaring outward from said dwell portion sufficient to make contact with said bearing point and to move the same a distance greater than the distance required to operate said switch means; and a detent portion, having a circumference less than the circumference of the distal end of the snap portion; wherein the weight of said of said actuator means is selected such that the force exerted by actuator means, applied at said snap portion to said bearing point as the transverse axis of said housing means moves from horizontal toward the vertical, to overcome the resistance of said spring loading of said switch means at a preselected angle of said housing, providing a snap action closing of said switch.

* * * * *